US006918385B2

(12) United States Patent
Ohkuma et al.

(10) Patent No.: US 6,918,385 B2
(45) Date of Patent: Jul. 19, 2005

(54) AIR-FUEL RATIO DETECTING APPARATUS OF ENGINE AND METHOD THEREOF

(75) Inventors: Shigeo Ohkuma, Atsugi (JP); Futoshi Ichiyanagi, Atsugi (JP)

(73) Assignee: Hitachi, Ltd., Tokyo-to (JP)

( * ) Notice: Subject to any disclaimer, the term of this patent is extended or adjusted under 35 U.S.C. 154(b) by 92 days.

(21) Appl. No.: 10/290,250

(22) Filed: Nov. 8, 2002

(65) Prior Publication Data

US 2003/0089358 A1 May 15, 2003

(30) Foreign Application Priority Data

Nov. 8, 2001 (JP) ..... 2001-343757

(51) Int. Cl.[7] ..... F02D 41/14
(52) U.S. Cl. ..... 123/694; 123/689
(58) Field of Search ..... 123/694, 676, 123/686, 689

(56) References Cited

U.S. PATENT DOCUMENTS 4,112,893 A * 9/1978 Anzai ..... 123/689
4,140,085 A * 2/1979 Rabus et al. ..... 123/693
4,156,404 A * 5/1979 Anzai ..... 123/694
4,324,218 A * 4/1982 Hattori et al. ..... 123/695
4,463,594 A * 8/1984 Raff et al. ..... 123/694
4,768,485 A * 9/1988 Brandner et al. ..... 123/694
5,140,535 A * 8/1992 Raff et al. ..... 123/694
5,322,047 A * 6/1994 Oliu et al. ..... 123/676

FOREIGN PATENT DOCUMENTS

JP 8-201105 A 8/1996
JP 11-229930 A 8/1999

* cited by examiner

*Primary Examiner*—Erick Solis
(74) *Attorney, Agent, or Firm*—Foley & Lardner LLP

(57) ABSTRACT

A temperature of an oxygen concentration detector generating an electromotive force according to a difference between oxygen concentration in an engine exhaust gas and oxygen concentration in the atmosphere, is detected, and coefficients in a transformation for converting the electromotive force to a value having a characteristic linear to an air-fuel ratio is modified according to the temperature.

19 Claims, 4 Drawing Sheets

AIR-FUEL RATIO DETECTING APPARATUS OF ENGINE AND METHOD THEREOF

FIELD OF THE INVENTION

The present invention relates to an apparatus and a method for detecting an air-fuel ratio of combustion mixture in an engine, based on oxygen concentration in an engine exhaust gas.

RELATED ART

Heretofore, there has been known a technique in which an output of an oxygen sensor having an output characteristic nonlinear to an input is converted so as to have a characteristic linear to the input (refer to Japanese Unexamined Patent Publication No. 8-201105).

Further, as an oxygen sensor detecting oxygen concentration in an engine exhaust gas, there has been known an oxygen sensor of oxygen concentration cell type generating an electromotive force according to a ratio between oxygen concentration in an exhaust gas and oxygen concentration in the atmosphere (refer to Japanese Unexamined Patent Publication No. 11-229930).

In the case where the constitution is such that the electromotive force of the oxygen sensor of oxygen concentration cell type is converted so as to have a characteristic linear to an air-fuel ratio, to detect the air-fuel ratio based on a detection output after conversion, due to temperature dependency of the sensor output characteristic, a correlation between the detection output after conversion and the air-fuel ratio is often changed to reduce air-fuel ratio detection accuracy.

SUMMARY OF THE INVENTION

Accordingly, the present invention has an object to provide an air-fuel ratio detecting apparatus of an engine and a method thereof, capable of holding a correlation between a detection output after conversion and an air-fuel ratio to be constant even if a temperature of an oxygen sensor is changed, thereby enabling to detect the air-fuel ratio with high accuracy.

In order to achieve the above object, the present invention is constituted such that a conversion characteristic of detection output of an oxygen concentration detector is modified according to a temperature of the oxygen concentration detector.

The other objects and features of this invention will become understood from the following description with reference to the accompanying drawings.

DETAILED DESCRIPTION OF THE INVENTION

Figure 1:
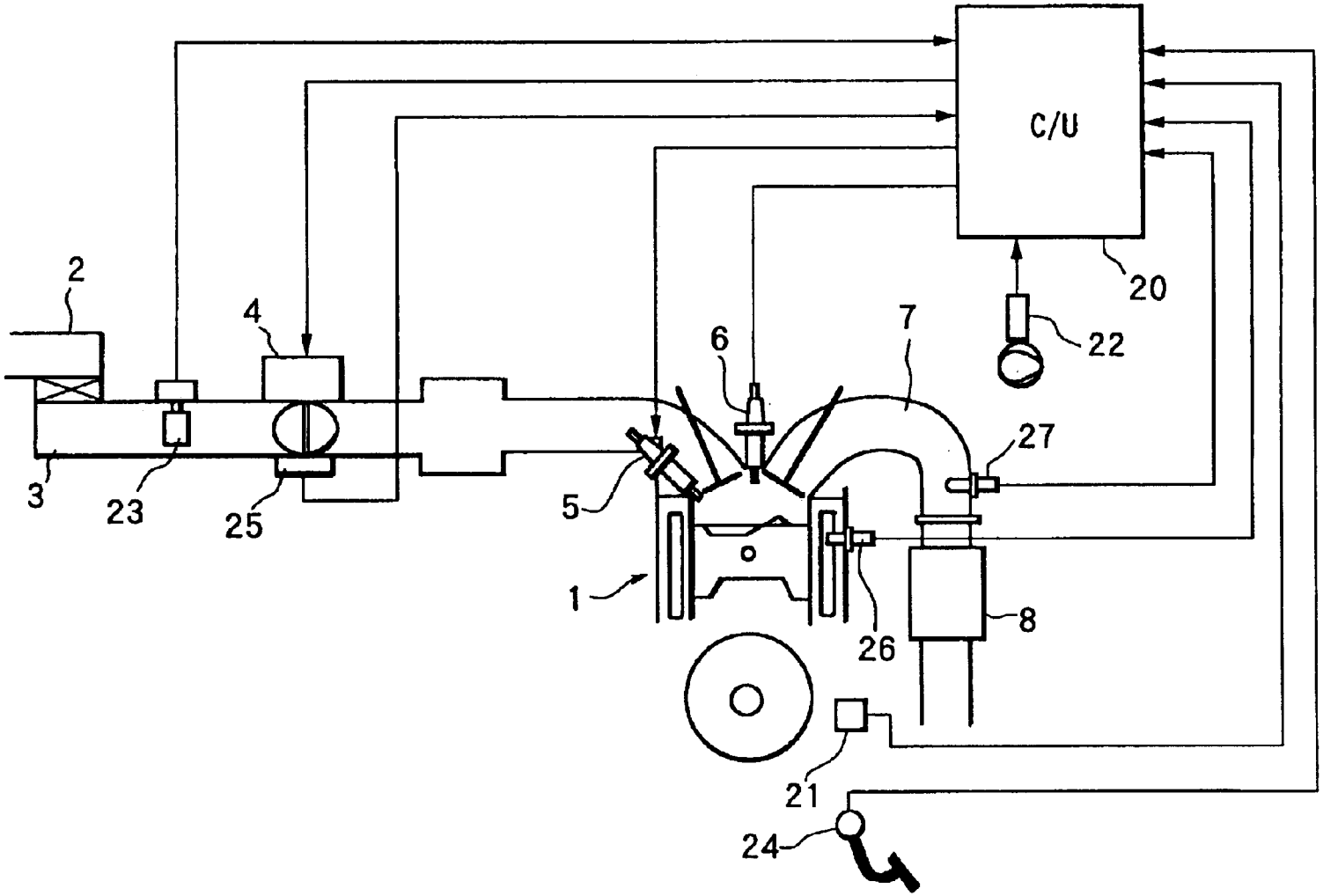
FIG. 1 is a diagram showing a system structure of an engine in an embodiment.

FIG. 1 is diagram showing a system structure of an engine in an embodiment.

An engine 1 shown in FIG. 1 is installed on a vehicle not shown in the figure.

Air is sucked into a combustion chamber of each cylinder in engine 1 via an air cleaner 2, an intake pipe 3, and an electronically controlled throttle 4.

An electromagnetic fuel injection valve 5 directly injects fuel (gasoline) into the combustion chamber of each cylinder.

In the combustion chamber, an air-fuel mixture is formed of fuel injected by fuel injection valve 5 and intake air.

Fuel injection valve 5 is opened by an injection pulse signal output from a control unit 20, to inject fuel adjusted at a predetermined pressure.

The air-fuel mixture formed in the combustion chamber is ignited to burn by an ignition plug 6.

Note, engine 1 is not limited to a direct injection type gasoline engine, and may be an engine configured to inject fuel to an intake port.

An exhaust gas from engine 1 is discharged from an exhaust pipe 7.

An exhaust purification catalyst 8 is disposed to exhaust pipe 7.

Catalyst 8 is a three-way catalyst having a capability to store oxygen.

This three-way catalyst oxidizes carbon monoxide CO and hydrocarbon HC, and reduces nitrogen oxide NOx, harmful three components, to convert them to harmless carbon dioxide, water vapor and nitrogen.

Purification performance of three-way catalyst 8 is highest when an exhaust air-fuel ratio equals to a stoichiometric air-fuel ratio. If the exhaust air-fuel ratio is lean, oxidization by three-way catalyst 8 becomes active but reduction thereby becomes inactive, on the contrary, the exhaust air-fuel ratio is rich, oxidization thereby becomes inactive but reduction thereby becomes active.

However, since three-way catalyst 8 has the capability to store oxygen, when the exhaust air-fuel ratio becomes temporarily rich, it is possible to perform an oxidization reaction using the oxygen stored up to that time, on the contrary, when the exhaust air-fuel ratio becomes temporarily lean, it is possible to perform a reduction reaction by storing excess oxygen.

Here, in order to maintain the exhaust purification performance utilizing the capability of three-way catalyst 8 to store oxygen, it is preferable to maintain an amount of oxygen to be stored in three-way catalyst 8 at around the half of maximum amount capable to be stored.

If the oxygen amount stored in three-way catalyst 8 is around the half of maximum amount capable to be stored, when the exhaust air-fuel ratio becomes lean, the excess oxygen can be stored, and also, when becomes rich, oxygen necessary for oxidizing process can be eliminated and supplied.

Therefore, when an air-fuel ratio feedback control condition is established, control unit 20 feedback controls a fuel injection quantity by fuel injection valve 5 so as to coincide an estimated value of stored oxygen amount in three-way catalyst 8 with a target amount.

Control unit 20 incorporates therein a microcomputer including a CPU, a ROM, a RAM, an A/D converter, an input/output interface and the like.

Control unit 20 receives detection signals output from various sensors, and controls a throttle opening of electronically controlled throttle 4, the injection quantity and injection timing of fuel injection valve 5, and ignition timing of ignition plug 6 by calculation process based on these detection signals.

As one of the various sensors, there is a crank angle sensor 21 detecting a crank angle of engine 1, and an engine rotation speed Ne is calculated based on a signal from crank angle sensor 21.

Other than the above, there are disposed a cam sensor 22 taking out a cylinder discrimination signal from a camshaft, an air flow meter 23 detecting an intake air amount Q at an upstream side of electronically controlled throttle 4, an accelerator sensor 24 detecting a depression amount APS of accelerator pedal, a throttle sensor 25 detecting a throttle opening TVO in electronically controlled throttle 4, and a water temperature sensor 26 detecting a cooling water temperature.

On an upstream side of catalyst 8, there is disposed an oxygen sensor 27 of oxygen concentration cell type using zirconia tube, that generates an electromotive force according to a ratio between oxygen concentration in engine exhaust and oxygen concentration in the atmosphere.

Figure 2:
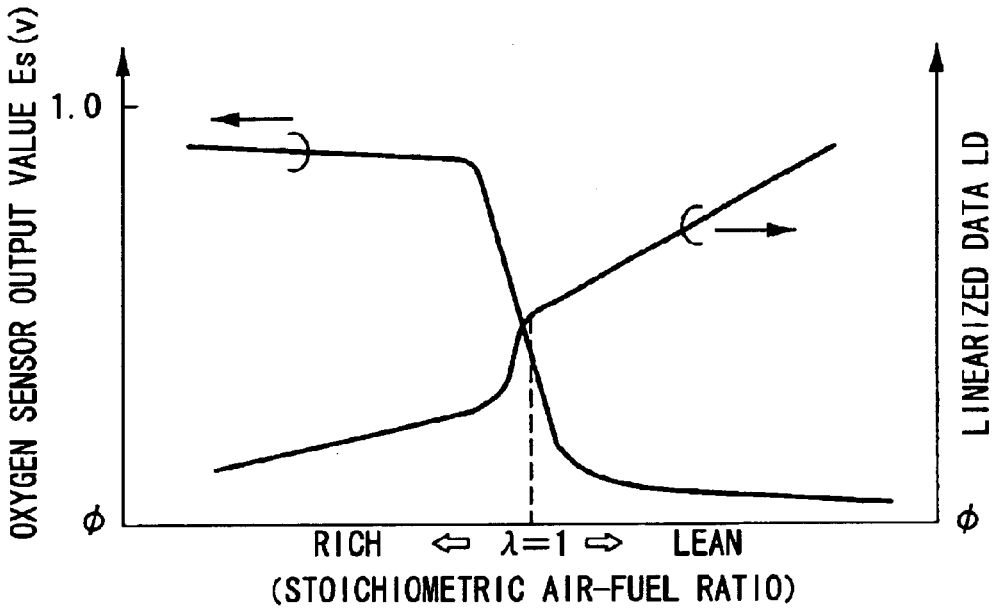
FIG. 2 is a graph showing an output characteristic and a characteristic of a detection output after conversion of an oxygen sensor in the embodiment.

Oxygen sensor 27 has a characteristic in that, as shown in FIG. 2, an electromotive force Es is abruptly changed on reaching the stoichiometric air-fuel ratio.

Control unit 20 detects an air-fuel ratio based on the electromotive force Es of oxygen sensor 27 and also estimates the stored oxygen amount in three-way catalyst 8 based on the air-fuel ratio, to feedback control the air-fuel ratio based on the estimated result.

Here, a state of air-fuel ratio control based on the stored oxygen amount by control unit 20 will be described in accordance with a block diagram in FIG. 3.

Figure 3:
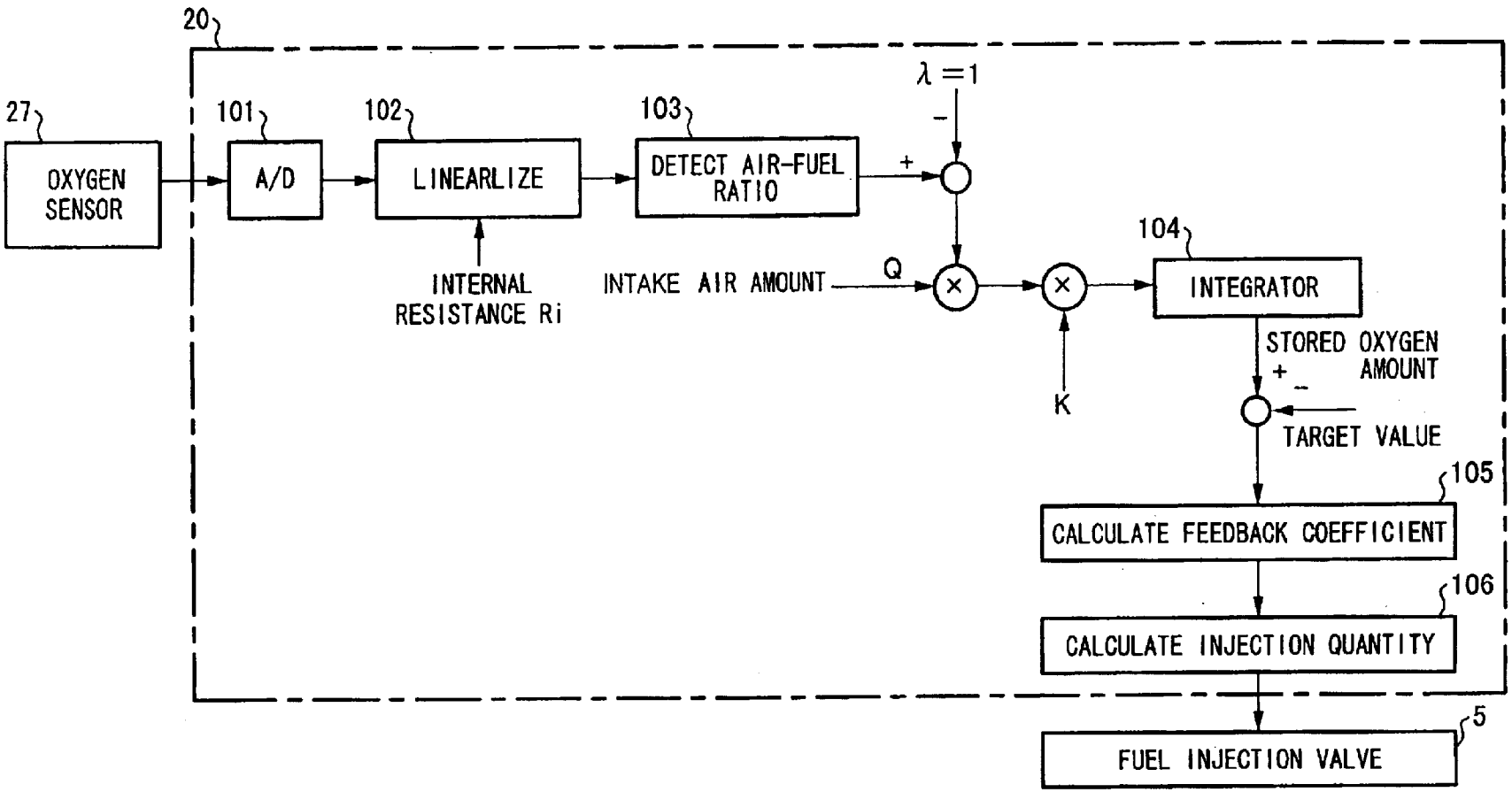
FIG. 3 is a block diagram showing an air-fuel ratio detection and an air-fuel ratio feedback control in the embodiment.

In the block diagram in FIG. 3, the electromotive force Es of oxygen sensor 27 is A/D converted by an A/D converter 101, to be read in a linearizing section 102.

In linearizing section 102, the electromotive force Es is converted to linearized data LD having a characteristic substantially linear to the air-fuel ratio (substantially proportional to an excess air ratio λ), based on a predetermined transformation.

The linearized data LD is converted to the air-fuel ratio (excess air ratio λ) based on a conversion table as shown in FIG. 2, in an air-fuel ratio detecting section 103.

The transformation is shown in the following.

$$\text{Linearized Data } LD = A\alpha - \beta b \mathrm{Exp}(A-0.5)/(0.5+A)^{-2}+50$$

$$A = \mathrm{Exp}(1-Es)/(0.04+Es)$$

$$\alpha = 150/a(Ri+150)$$

$$\beta = 150/c(0.4Ri+150)$$

In the above transformation, "a", "b" and "c" are constants, Ri is an internal resistance that is changed according to a temperature of oxygen sensor 27, α is a correction coefficient on lean side according to the internal resistance Ri, and β is a correction coefficient on rich side according to the internal resistance Ri.

According to the above transformation, a conversion characteristic of the electromotive force Es to the linearized data LD is modified by the internal resistance Ri, in other words, an element temperature of oxygen sensor 27.

Accordingly, since the linearized data LD can be obtained corresponding to variations in output characteristic of the electromotive force Es due to the element temperature, even if the element temperature is changed, it is possible to accurately obtain the air-fuel ratio from the linearized data LD using a single conversion table.

Figure 4:
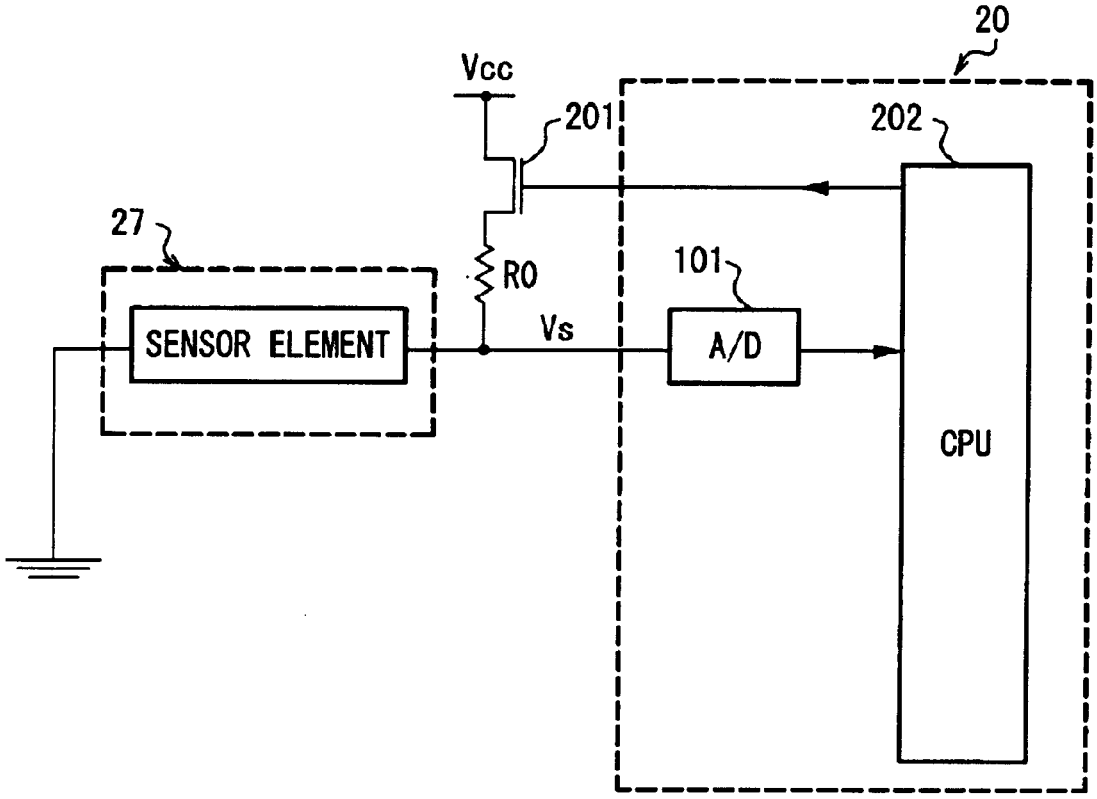
FIG. 4 is a circuit diagram showing a constitution for detecting an internal resistance of the oxygen sensor in the embodiment.

The internal resistance Ri is detected by a circuit structure as shown in FIG. 4.

The sensor element of oxygen sensor 27 is applied with a predetermined voltage Vcc for measuring an internal resistance via a switching element 201 and a reference resistance R0.

A CPU 202 constituting control unit 20 controls the ON/OFF of switching element 201, to switch between the detection of air-fuel ratio and the detection of internal resistance Ri.

Further, when detecting the air-fuel ratio, CPU 202 turns switching element 201 OFF, so that the electromotive force Es generated according to the oxygen concentration is read into CPU 202.

On the contrary, when measuring the internal resistance Ri of oxygen sensor 27, CPU 202 turns switching element 201 ON so that the voltage Vcc for measuring the internal resistance is superimposed on the sensor electromotive force Es, and calculates the internal resistance Ri based on the voltage read at this time.

If an electric current flowing through the element of oxygen sensor 27 is "i", since Vs=i×Rs and Vcc−Vs=i×R0, then from both of the above equations, Rs=Vs/[(Vcc−Vs)/R0] can be obtained.

Therefore, the internal resistance Ri is calculated based on the voltage Vcc and reference resistance value R0, that are known, and a voltage Vs read via A/D converter 101.

A deviation Δλ between the thus detected air-fuel ratio (excess air ratio λ) and the stoichiometric air-fuel ratio (excess air ratio λ=1) is calculated.

$$\Delta\lambda = \text{detection value of excess air ratio } \lambda - 1.0$$

Next, the intake air amount Q equivalent to the exhaust gas amount detected by air flow meter 23 is multiplied by the deviation Δλ.

The above mentioned air-fuel ratio deviation Δλ becomes a positive value if the air-fuel ratio of combustion mixture is leaner than the stoichiometric air-fuel ratio, while becomes a negative value if the air-fuel ratio of combustion mixture is richer than the stoichiometric air-fuel ratio.

Such a positive/negative change of Δλ corresponds to the fact that, if the air-fuel ratio of combustion mixture is leaner than the stoichiometric air-fuel ratio, the stored oxygen amount in catalyst 8 is changed to increase, while if the air-fuel ratio of combustion mixture is richer than the stoichiometric air-fuel ratio, the stored oxygen amount in catalyst 8 is changed to decrease.

A multiplication result of the intake air amount Q and the air-fuel ratio deviation Δλ is further multiplied by a constant K, to obtain an oxygen amount flowing into the catalyst at present time.

In an integrator 104, the oxygen amount flowing into the catalyst is sequentially integrated, to obtain the stored oxygen amount in catalyst 8.

Next, a deviation between an estimated value of the stored oxygen amount output from integrator 104 and a target value is calculated.

The target value is set to a value the half of the maximum stored oxygen amount.

Then, data of stored oxygen amount deviation is input to an air-fuel ratio feedback correction coefficient setting section 105.

In air-fuel ratio feedback correction coefficient setting section 105, an air-fuel ratio feedback correction coefficient (an air-fuel ratio feedback control signal) for correcting the fuel injection quantity is calculated, so that the estimated value of the stored oxygen amount coincides with the target value.

That is, the air-fuel ratio feedback correction coefficient is set so that, when the stored oxygen amount is less than a target amount, the air-fuel ratio is made leaner to increase the stored oxygen amount, while when the stored oxygen amount is larger than the target amount, the air-fuel ratio is made richer to eliminate the excess oxygen, to decrease the stored oxygen amount.

In an injection quantity calculating section 106, a basic fuel injection quantity is corrected using the air-fuel ratio feedback correction coefficient to calculate a final fuel injection quantity, and the injection pulse signal corresponding to the fuel injection quantity is output to fuel injection valve 5 at predetermined timing.

In the above embodiment, the constitution has been such that the electromotive force Es of oxygen sensor 27 is subjected to linearizing process, to obtain the air-fuel ratio, and the stored oxygen amount in catalyst 8 is estimated based on the obtained air-fuel ratio. However, the process after detecting the air-fuel ratio is not limited thereto, and the constitution may be such that, for example, the fuel injection quantity is feedback controlled so that the detected air-fuel ratio becomes a target air-fuel ratio.

Further, in the above embodiment, the constitution has been such that the characteristic of linearize conversion is modified based on the internal resistance Ri, since the internal resistance Ri of oxygen sensor 27 is changed according to the temperature. However, the constitution may be such that the element temperature of oxygen sensor 27 is detected by a temperature sensor, and the conversion characteristic (correction coefficients $\alpha$ and $\beta$ in the transformation) is modified based on the element temperature detected by the temperature sensor.

The entire contents of Japanese Patent Application No. 2001-343757, filed Nov. 8, 2001, a priority of which is claimed, are incorporated herein by reference.

While only selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

What is claimed are:

1. An air-fuel ratio detecting apparatus of an engine for detecting an air-fuel ratio of a combustion mixture in the engine, said apparatus comprising:

an oxygen concentration detector generating a detection signal according to oxygen concentration in an engine exhaust gas, said detection signal being abruptly changed upon said air-fuel ratio reaching a stoichiometric air-fuel ratio;

a temperature detector generating a detection signal according to a temperature of said oxygen concentration detector; and an air-fuel ratio calculator receiving the detection signal from said oxygen concentration detector and the detection signal from said temperature detector, to calculate the air-fuel ratio based on these detection signals, wherein said air-fuel ratio calculator converts the detection signal from said oxygen concentration detector to a value having a characteristic linear to the air-fuel ratio in an air-fuel ratio area containing therein the stoichiometric air-fuel ratio, to calculate the air-fuel ratio based on the value after conversion, and modifies said conversion characteristic of the detection signal in the air-fuel ratio area containing therein said stoichiometric air-fuel ratio according to the temperature of said oxygen concentration detector.

2. An air-fuel ratio detecting apparatus of an engine according to claim 1, wherein said temperature detector detects an internal resistance of an element of said oxygen concentration detector.

3. An air-fuel ratio detecting apparatus of an engine according to claim 1, wherein said air-fuel ratio detector converts the detection signal from said oxygen concentration detector based on a predetermined transformation, and modifies coefficients of said transformation according to the temperature of said oxygen concentration detector.

4. An air-fuel ratio detecting apparatus of an engine according to claim 1, wherein said oxygen concentration detector generates an electromotive force based on a difference between the oxygen concentration in the engine exhaust gas and oxygen concentration in the atmosphere.

5. An air-fuel ratio detecting apparatus of an engine according to claim 1, wherein said oxygen concentration detector generates an electromotive force based on a difference between the oxygen concentration in the engine exhaust gas and oxygen concentration in the atmosphere, and said air-fuel ratio calculator is constituted to convert an electromotive force Es of said oxygen concentration detector to a value LD having a characteristic linear to the air-fuel ratio, based on the following equations;

$$LD=A\alpha-\beta b\mathrm{Exp}\ (A-0.5)/(0.5+A)^{-2}+50$$

in which A=Exp (1−Es)/(0.04+Es)

b=constant, to modify said coefficients $\alpha$ and $\beta$ according to the temperature of said oxygen concentration detector.

6. An air-fuel ratio detecting apparatus of an engine according to claim 5, wherein said temperature detector detects an internal resistance Ri of an element of said oxygen concentration detector, and said air-fuel ratio calculator calculates said coefficients $\alpha$ and $\beta$ provided that;

$\alpha$=150/a (Ri+150), $\beta$=150/c (0.4Ri+150), and a, c constants.

7. An air-fuel ratio detecting apparatus of an engine according to claim 1, wherein said oxygen concentration detector generates an electromotive force based on a difference between the oxygen concentration in the engine exhaust gas and oxygen concentration in the atmosphere, and said temperature detector superimposes a voltage for measuring an internal resistance on said electromotive force, to calculate the internal resistance based on the voltage at this time.

8. An air-fuel ratio detecting apparatus of an engine for detecting an air-fuel ratio of a combustion mixture in the engine, said apparatus comprising:

oxygen concentration detecting means for generating a detection signal according to oxygen concentration in an engine exhaust gas, said detection signal being abruptly changed upon said air-fuel ratio reaching a stoichiometric air-fuel ratio;

temperature detecting means for detecting a temperature of said oxygen concentration detecting means;

converting means for converting the detection signal from said oxygen concentration detecting means to a value having a characteristic linear to the air-fuel ratio in an air-fuel ratio area containing therein the stoichiometric air-fuel ratio;

air-fuel ratio calculating means for calculating the air-fuel ratio based on the value converted by said converting means; and conversion characteristic modifying means for modifying a conversion characteristic of the detection signal by said converting means in the air-fuel ratio area containing therein said stoichiometric air-fuel ratio according to the temperature of said oxygen concentration detecting means.

9. An air-fuel ratio detecting method of an engine, for detecting an air-fuel ratio of a combustion mixture in the engine using an oxygen concentration detector generating a detection signal according to oxygen concentration in an engine exhaust gas, said detection signal being abruptly changed upon said air-fuel ratio reaching a stoichiometric air-fuel ratio, said method comprising the steps of:

converting the detection signal of said oxygen concentration detector to a value having a characteristic linear to an air-fuel ratio in an air-fuel ratio area containing therein the stoichiometric air-fuel ratio;

calculating the air-fuel ratio based on said converted value;

detecting a temperature of said oxygen concentration detector; and modifying a conversion characteristic of said detection signal in the air-fuel ratio area containing therein the stoichiometric air-fuel ratio according to the temperature of said oxygen concentration detector.

10. An air-fuel ratio detecting method of an engine according to claim 9, wherein said step of detecting a temperature comprises detecting an internal resistance of an element of said oxygen concentration detector.

11. An air-fuel ratio detecting method of an engine according to claim 9, wherein said step of converting a detecting signal comprises a step of converting the detection signal from said oxygen concentration detector based on a predetermined transformation, and said step of modifying a conversion characteristic comprises a step of modifying coefficients of said transformation according to the temperature of said oxygen concentration detector.

12. An air-fuel ratio detecting method of an engine according to claim 9, wherein said oxygen concentration detector generates an electromotive force based on a difference between the oxygen concentration in the engine exhaust gas and oxygen concentration in the atmosphere.

13. An air-fuel ratio detecting method of an engine according to claim 9, wherein said oxygen concentration detector generates an electromotive force Es based on a difference between the oxygen concentration in the engine exhaust gas and oxygen concentration in the atmosphere, said step of converting a detection signal comprises a step of converting said electromotive force Es to a value LD having a characteristic linear to the air-fuel ratio, based on the following equations;

$$LD=A\alpha-\beta b\mathrm{Exp}(A-0.5)/(0.5+A)^{-2}+50$$

in which A=Exp (1−Es)/(0.04+Es)

b=constant, and said step of modifying a conversion characteristic comprises a step of modifying said coefficients α and β according to the temperature of said oxygen concentration detector.

14. An air-fuel ratio detecting method of an engine according to claim 13, wherein said step of detecting a temperature comprises a step of detecting an internal resistance Ri of an element of said oxygen concentration detector, and said step of modifying a conversion characteristic comprises a step of calculating said coefficients α and β provided that;

α=150/a (Ri+150),

β=150/c (0.4Ri+150), and a, c=constants.

15. An air-fuel ratio detecting method of an engine according to claim 9, wherein said oxygen concentration detector generates an electromotive force based on a difference between the oxygen concentration in the engine exhaust gas and oxygen concentration in the atmosphere, and said step of detecting a temperature comprises a step of superimposing a voltage for measuring an internal resistance on said electromotive force, and calculating the internal resistance based on the voltage at this time.

16. An air-fuel ratio detecting apparatus of an engine for detecting an air-fuel ratio of a combustion mixture in the engine, said apparatus comprising:

an oxygen concentration detector generating an electromotive force Es based on a difference between the oxygen concentration in the engine exhaust gas and oxygen concentration in the atmosphere;

a temperature detector generating a detection signal according to a temperature of said oxygen concentration detector; and an air-fuel ratio calculator receiving the detection signal from said oxygen concentration detector and the detection signal from said temperature detector, to calculate the air-fuel ratio based on these detection signals, wherein said air-fuel ratio calculator converts the electromotive force Es of said oxygen concentration detector to a value LD having a characteristic linear to the air-fuel ratio, based on the following equations;

$$LD=A\alpha-\beta b\mathrm{Exp}(A-0.5)/(0.5+A)^{-2}+50$$

where A=Exp (I−Es)/(0.04+Es), and b=constant, to modify said coefficients α and β according to the temperature of said oxygen concentration detector, and to calculate the air-fuel ratio based on said value LD.

17. An air-fuel ratio detecting apparatus of an engine according to claim 16, wherein said temperature detector detects an internal resistance Ri of an element of said oxygen concentration detector, and said air-fuel ratio calculator calculates said coefficients α and β such that;

α=150/a (Ri+150),

β=150/c (0.4Ri+150), and a, c=constants.

18. An air-fuel ratio detecting method of an engine, for detecting an air-fuel ratio of a combustion mixture in the engine using an oxygen concentration detector generating an electromotive force Es based on a difference between the oxygen concentration in the engine exhaust gas and oxygen concentration in the atmosphere, said method comprising the steps of:

converting the electromotive force Es of said oxygen concentration detector to a value LD having a characteristic linear to the air-fuel ratio, based on the following equations;

$$LD=A\alpha-\beta b\mathrm{Exp}(A-0.5)/(0.5+A)^{-2}+50$$

where A=Exp (I−Es)/(0.04+Es), and b=constant, detecting a temperature of said oxygen concentration detector;

modifying said coefficients α and β according to the temperature of said oxygen concentration detector; and calculating the air-fuel ratio based on said value LD.

19. An air-fuel ratio detecting method of an engine according to claim 18, wherein said step of detecting a temperature comprises a step of detecting an internal resistance Ri of an element of said oxygen concentration detector, and wherein said step of modifying a conversion characteristic comprises a step of calculating said coefficients α and β such that;

α=150/a (Ri+150),

β=150/c (0.4Ri+150), and a, c=constants.

* * * * *